US005979857A

United States Patent [19]

Holm

[11] Patent Number: 5,979,857

[45] Date of Patent: Nov. 9, 1999

[54] BOOK HOLDER AND STAND ASSEMBLY

[76] Inventor: George C. Holm, 12527 Mission Hills Cir. South, Jacksonville, Fla. 32225

[21] Appl. No.: 08/949,933

[22] Filed: Oct. 14, 1997

[51] Int. Cl.[6] ..... A47B 19/00

[52] U.S. Cl. ..... 248/451; 248/441.1; 248/448; 248/124.1

[58] Field of Search ..... 248/451, 453, 248/452, 298.1, 122.1, 124.1, 279.1, 445, 441.1, 446, 447, 448

[56] References Cited

U.S. PATENT DOCUMENTS

| | | | |
|---|---|---|---|
| 343,877 | 6/1886 | Wheatley | 248/453 |
| 757,408 | 4/1904 | Noble | 248/451 X |
| 992,509 | 5/1911 | Kobzy | 248/453 |
| 1,239,655 | 9/1917 | Wood | 248/451 |
| 1,376,272 | 4/1921 | Handley | 248/451 |
| 1,609,180 | 11/1926 | Motono | 248/445 |
| 1,754,006 | 4/1930 | Anderson | 248/124.1 X |
| 2,386,266 | 10/1945 | Robertson | 248/124.1 |
| 2,810,231 | 10/1957 | Lykes | 248/451 |
| 4,978,096 | 12/1990 | Struckmann | 248/451 |

FOREIGN PATENT DOCUMENTS

| | | | |
|---|---|---|---|
| 593428 | 2/1925 | France | 248/451 |
| 525298 | 8/1940 | United Kingdom | 248/451 |

*Primary Examiner*—Ramon O. Ramirez
*Assistant Examiner*—Stephen S. Wentsler

[57] ABSTRACT

The present invention relates to an adjustable book holder which can be attached to a stand to permit hands-free reading and hand-assisted page turning in a sitting or reclining position. It provides for a one piece book support shelf and back of rigid material, such as a molded clear plastic or metal, onto which a book is secured and one or more pages are held open and flat by a single length of monofilament line attached to opposite sides of a swing arm held in a closed position. A swing arm in the open position allows unobstructed page turning after which the swing arm is returned to the closed position. The swing arm is held in the closed position by free swinging latches fastened to the swing arm and turned up behind the book support back. The swing arm is moved to the open position by pushing back against the swing arm which removes the pressure against the latches allowing the latches to drop clear. The swing arm is rotated down until parallel with the bottom of the book support shelf, limited by a stop rigidly connected to the bottom center of the swing arm and with the stop extension in contact with the underside of the book support bracket. In this position the monofilament line is below the book support shelf and the book page can now be turned. The swing arm is then returned to the closed position.

4 Claims, 10 Drawing Sheets

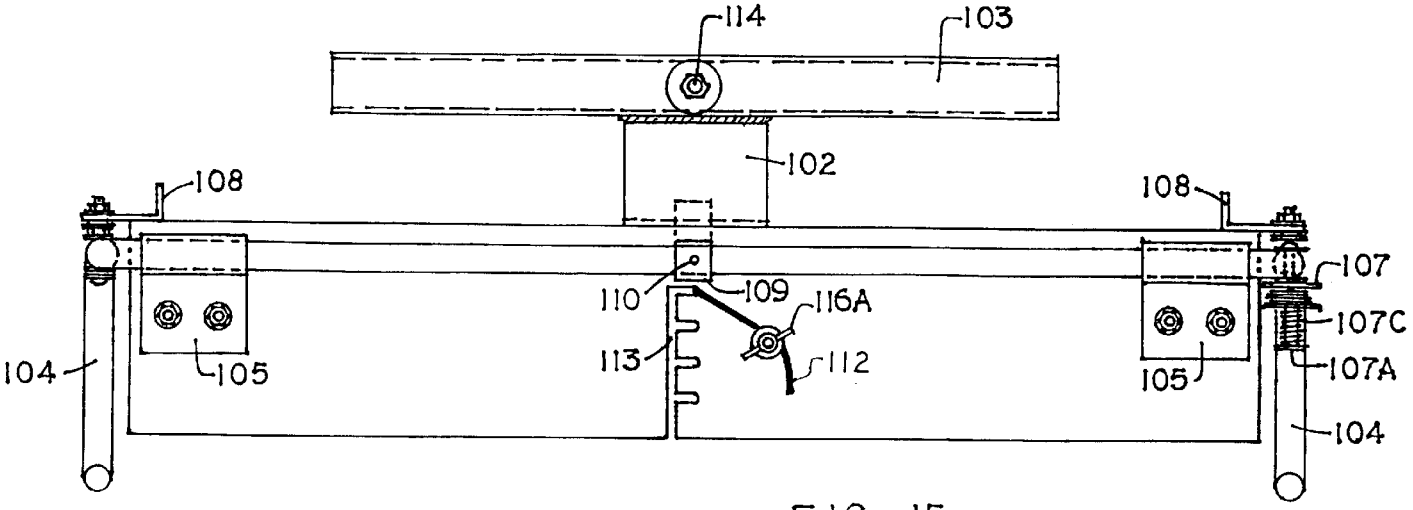
FIG. 15
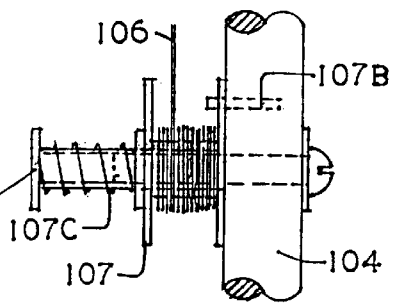
FIG. 19
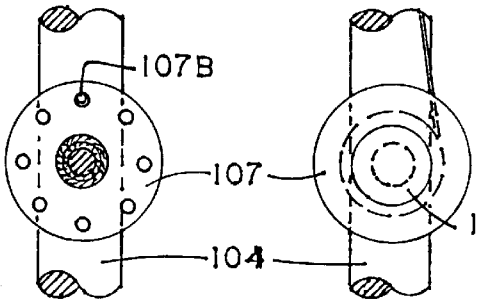
FIG. 18
FIG. 17
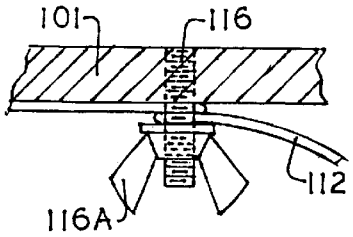
FIG. 16

BOOK HOLDER AND STAND ASSEMBLY

FIELD OF THE INVENTION

The present invention relates to an adjustable book holder which can be attached to a stand to permit hands-free reading and to allow easy, hand-assisted page turning in a variety of comfortable sitting and reclining positions.

BACKGROUND OF THE INVENTION

To facilitate the reading of books and magazines, various book holders have been suggested and exist in the prior art. Typically, the prior art addresses the problem of reading in a sitting position where no reasonably flat surface exists for resting the book. This most often is experienced when reading in bed or in a chair that is not directly in front of a table or a desk where the book can be placed. Normally when one holds a book in front of hint for an extended time, the weight of the book combined with holding one's arms stretched the required distance place a strain on the arms, shoulders and eventually the often enjoyable act of reading gives way in favor of rest.

In order to help readers cope with the aforementioned problems and inconveniences, most prior art permits the leading material to rest on a flat surface that is elevated at a distance that is comfortably readable. Most of the prior art therefore includes a flat surface upon which to rest the book or magazine, a stand that adjusts the height of the reading material relative to the readers' eye sight, a means for holding the book and in the more advanced schemes, a means for the reader to turn the pages.

U.S. Pat. No. 376,593 (Greenawait et al.), U.S. Pat. No. 1,083,764 (Smith), U.S. Pat. No. 1,692,337 (Forbes), U.S. Pat. No. 2,136,702 (Manierre), U.S. Pat. No. 4,596,372 (Ford), U.S. Pat. No. 4,702,453 (Bishop) and U.S. Pat. No. 5,351,927 (Howell) are but a few of the patents covering book holders. However, the prior art book holders are difficult to use, particularly when turning a books' pages. Additionally, the page restraining devices often interfere with the readers' view because the device to restrain pages either obscures the print or reflects light back into the readers' eyes.

SUMMARY OF THE INVENTION

The present invention relates to an adjustable book holder which can be attached to a stand to permit hands-free reading and hand assisted page turning in a sitting or reclining position. It is a principal object of the invention to provide a book holder which is simple in construction, easy to use, able to secure books in a variety of positions and provide an unobstructed view of the printed matter, thus allowing the reader to read comfortably in a sitting or reclining mode. The book holder feature adapts to a stand which offers a great range of adjustments for various types of use such as at home or in hospitals, either in chairs or in beds, permitting the reader to rise from a sitting or reclining position with little effort. In its' commercial form it represents a clean, functional article of furniture, easy to assemble or dissemble and consists of components connected by conventional fastening devices.

The present invention solves the problems encountered with the prior art constructions by providing a one piece book support shelf and back of rigid material, such as a molded clear plastic or metal, onto which a book is secured and one or more pages are held open and flat by a single strand of monofilament line attached to opposite sides of a swing arm held in a closed position. The swing arm in the open position allows unobstructed page turning after which the swing arm is returned to the closed position. The swing arm rotates freely through the hinge leaves fastened to the underside of the book support shelf. The swing arm is held in the closed position (pages held flat by the monofilament line) by free swinging latches fastened to the swing arm and turned up behind the book support back. The latches are kept in place by the outward pressure exerted by the book upon the monofilament line and the transfer of this pressure to the latches against the back of the book support. The swing arm is moved to the open position by pushing back against the swing arm which removes the pressure against the latches allowing the latches to drop clear, the swing arm is rotated down until parallel with the bottom of the book support shelf, limited by a stop rigidly connected to the bottom center of the swing arm and with the stop extension in contact with the underside of the book support bracket. In this position the monofilament line is below the book support shelf and the book page can now be turned. The swing arm is then returned to the closed position. The monofilament line can be adjusted to books of different widths or thicknesses by a spool wound with the monofilament line and mounted on one side of the swing arm, which can then be rotated to the correct tension and locked in place. The book is held to the book support by a cord looped over a hook at the back of the book support and placed in the center of the book when opened at the approximate mid point, then tightened and secured by a threaded post and nut at the bottom of the book support shelf.

A stand to support the book support typically includes a base, a lower upright post and an upper upright post adjustable relative to one another which are fixedly supported on the base, and a lateral post which can retract through a set of rollers mounted in a box section supported by the upper upright post, all members being of square tubular material. A base contains holes at ends through which casters are placed and secured. The book holder rotates about the axis of a cylindrical tube parallel to the book support and fastened to a bracket which is then itself fastened to the back of the book support. The end of the cylindrical tube fits into the end of the lateral square cross-sectioned post and can thereby be rotated and locked in any convenient position.

An object of the present invention is to permit hands-free holding of a book while reading and allows the book to be held in various comfortable positions relative to the readers' body.

A further object of the present invention is to allow simple page turning.

Another object of the invention is to hold the pages of the book flat and provide unobstructed viewing of the text.

Still another object of the present invention is to permit major adjustments to the book holder to accomodate different sized books.

Yet another object of the present invention is to provide a book holder and accompanying stand which can be shipped dissassembled for subsequent easy assembly by the user.

BRIEF DESCRIPTION OF THE DRAWINGS

The novel features of the present invention are set forth with particularity in the appended claims. The invention itself, however, both as to its' organization and method of operation, together with further objects and advantages thereof, may be best understood by reference to the following description taken in conjunction with the accompanying drawings, in which:

FIG. 15 is a bottom view of FIG. 9.

FIG. 16 is a partial cross sectional view showing the means of securing the cord to the bottom of the book support shelf.

FIG. 17 is a cross sectional view of the binding post and monofilament wound spool showing a circle of holes in the back face of the spook with the locking pin in the top center hole.

FIG. 18 is a front view of FIG. 19.

FIG. 19 is a partial side elevational view showing the binding post inserted through the monofilament wound spool and compression spring and fastened to the swing arm.

DESCRIPTION OF THE PREFERRED EMBODIMENTS

Figure 1:
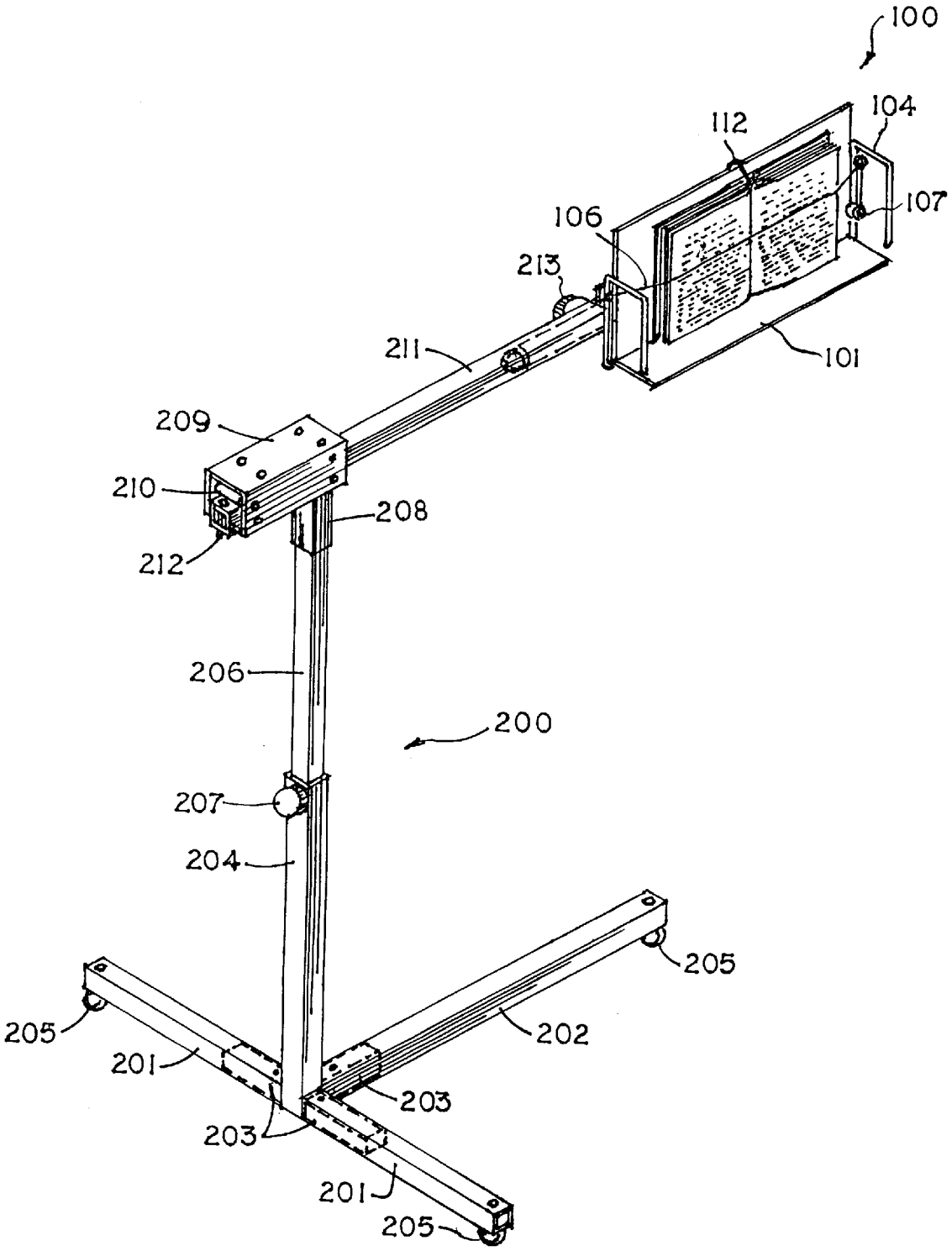
FIG. 1 is an isometric view of a book holder and stand assembly in accordance with the present invention.
Figure 2:
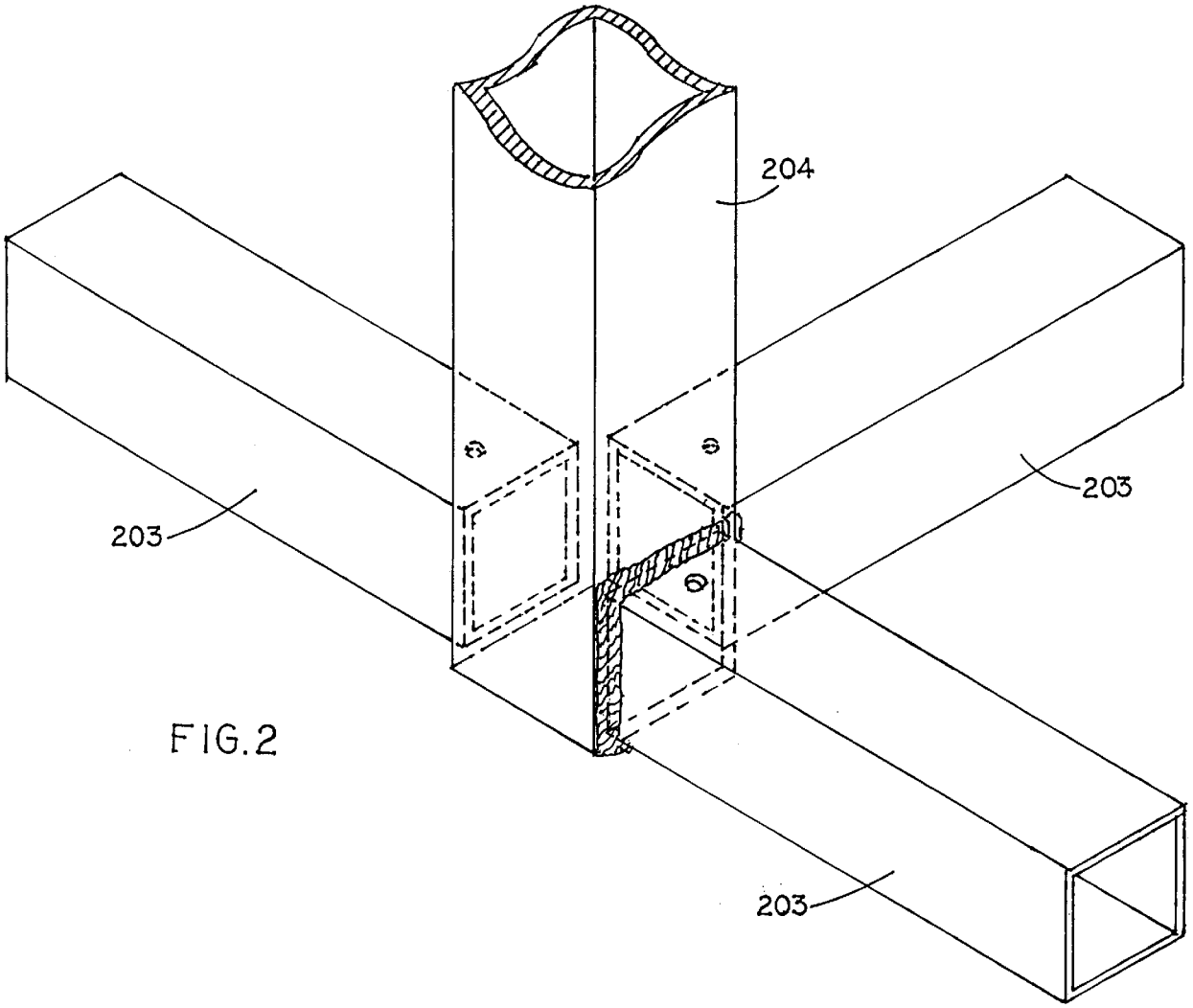
FIG. 2 is an isometric view of the lower upright post and horizontal leg supports of the stand.
Figure 3:
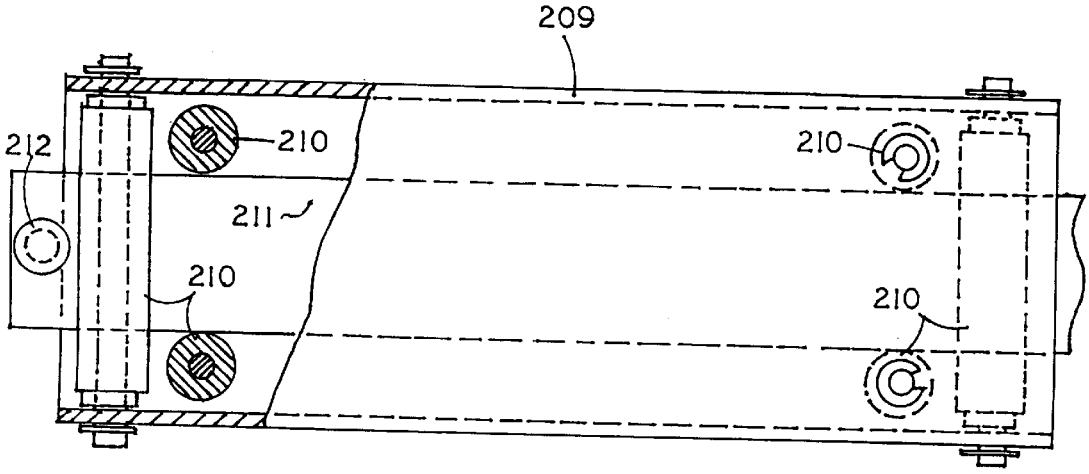
FIG. 3 is a front elevational view of the box section of the stand wherein the rollers are mounted.
Figure 4:
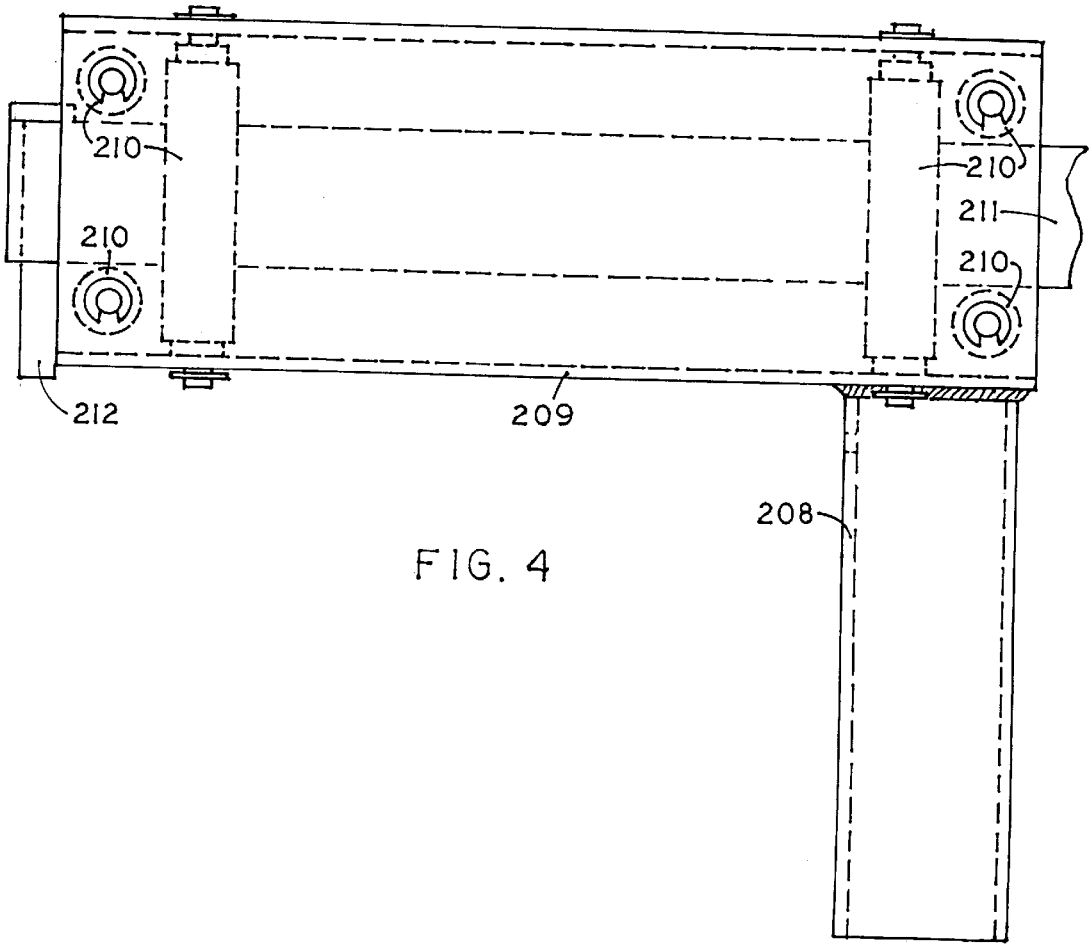
FIG. 4 is a cutaway view of the rollers relative to the lateral post.
Figure 5:
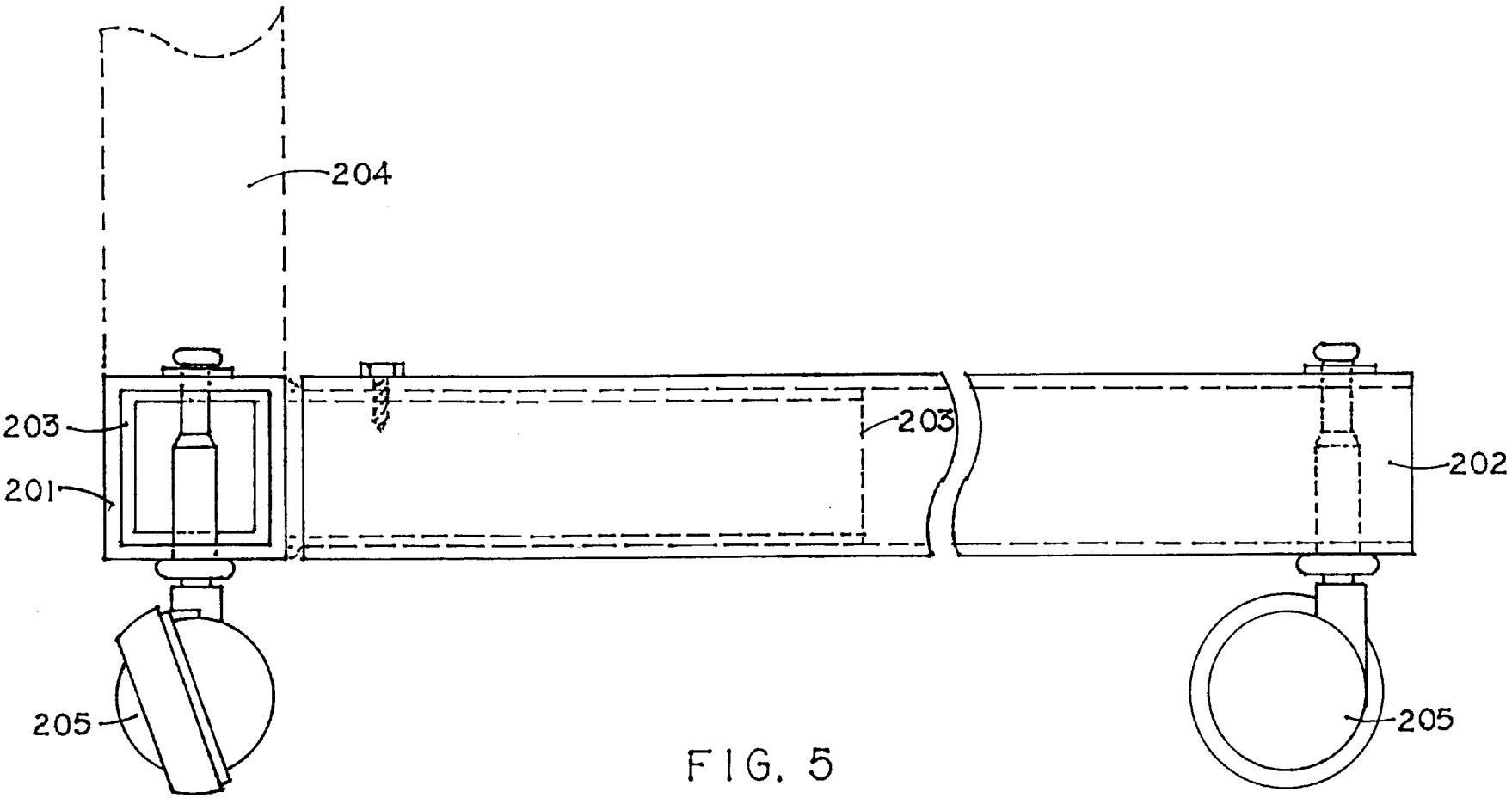
FIG. 5 is a side elevational view of the stand base showing the long leg secured over the stub support and the casters in place at the leg ends.
Figure 6:
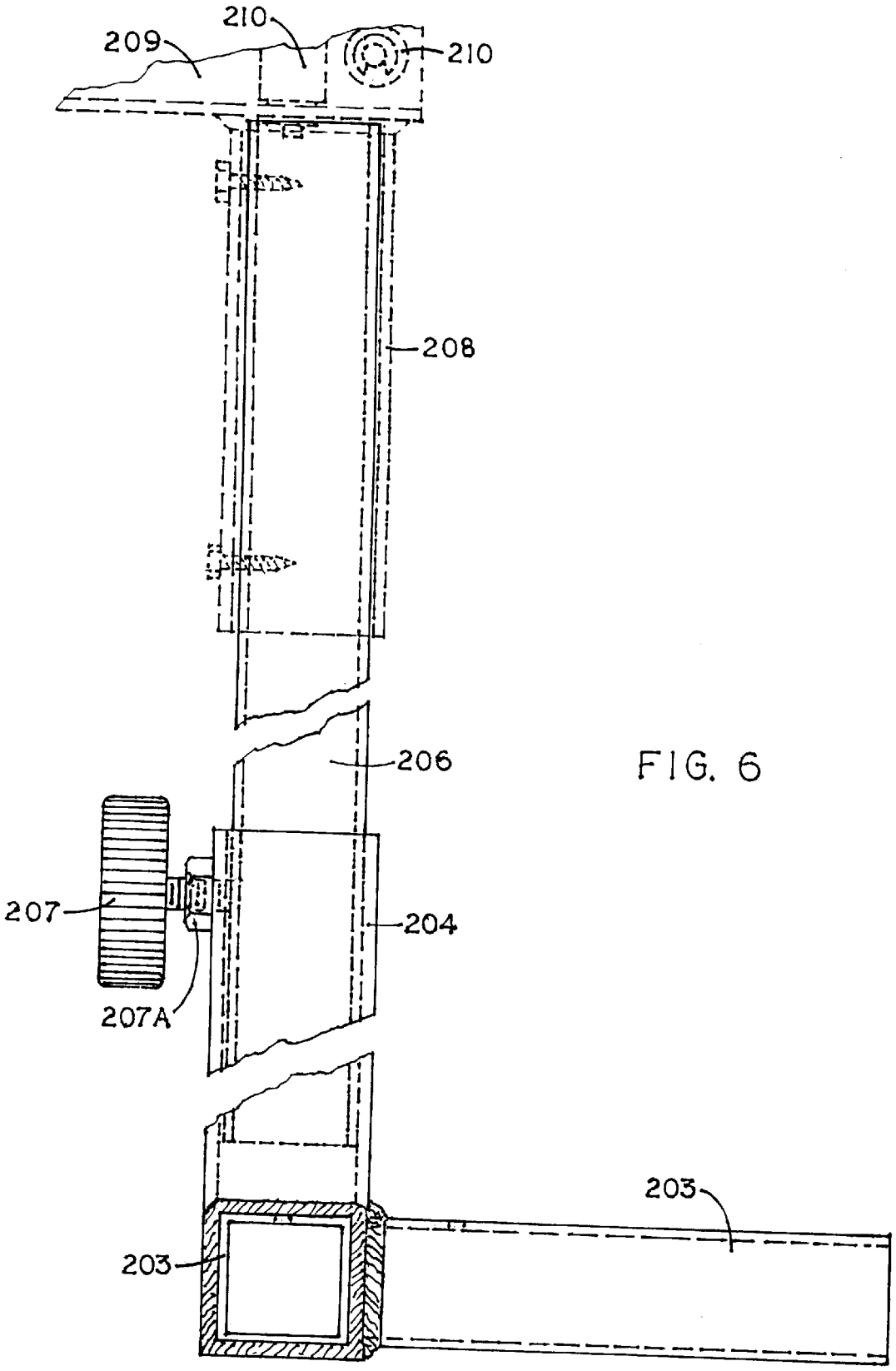
FIG. 6 is a side elevational view of the lower and upper upright posts and their means of height adjustment.
Figure 7:
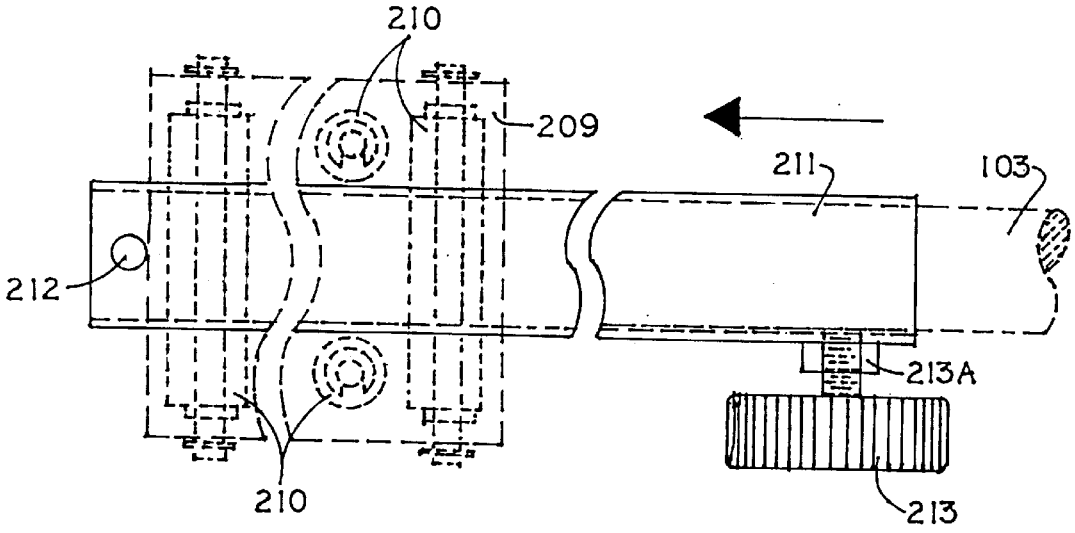
FIG. 7 is a side elevational view of the lateral post showing the means of adjusting the book holder rotation.
Figure 8:
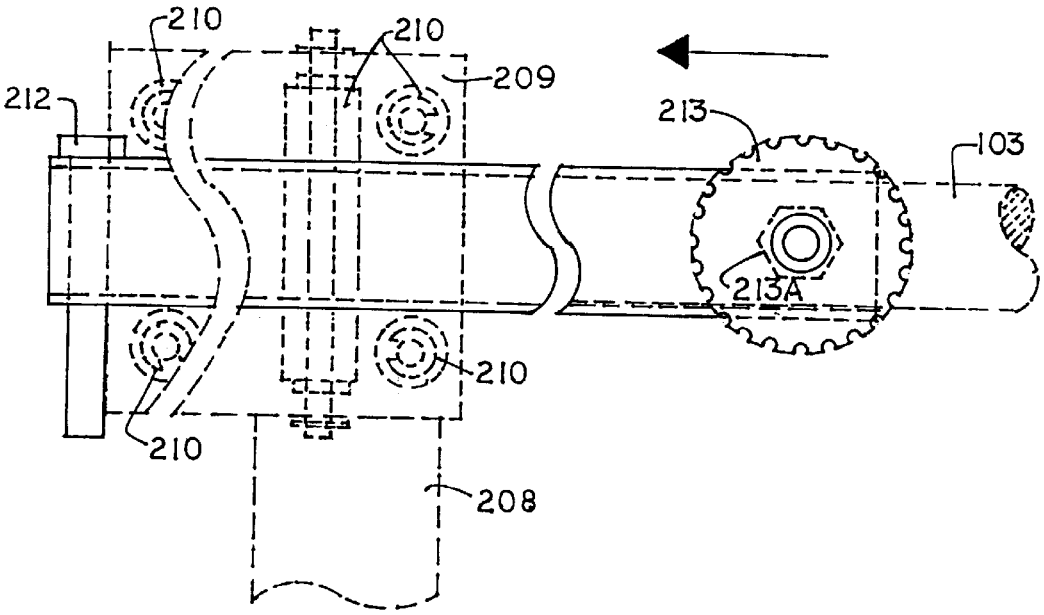
FIG. 8 is a top view of FIG. 7.

Referring now to the drawings wherein like reference numbers are used throughout the various views. FIG. 1 illustrates the book holder 100 and the stand 200 in accordance with the present invention. The base of the stand 200 includes three square tubular horizontal legs, two legs 201 and one leg 202 perpendicular to legs 201. The three legs fit snugly over three square tubular stub legs 203, which in the preferred embodiment are fastened to the lower upright post 204. As in FIG. 2 the stubs are shown secured by a screw or bolt. Low profile casters 205 are inserted into bores at the ends of the three legs, 201, 202 and secured. As shown in FIG. 6 the upper upright post 206 fits snugly into the lower upright post 204 and vertical adjustment is maintained by a knob and bolt 207 threading through a 207A permanently affixed to the lower upright-post 204 and passing through a co-axial bore in the post which is slightly larger than the bolt size which then bears against the upper upright post 206. The upper upright post 206 and lower upright post 204 are prevented from pivoting relative to each other by their square configuration. The upper upright post 206 fits snugly inside a square tubular stub post 208 and is secured by a srew or bolt. In FIG. 1 the stub post 208 is permanently affixed to the bottom of a horizontal square tubular box 209 at the end facing the book holder 100. FIG. 3 and FIG. 4 illustrates that the box 209 is open at both ends and mounted within are four horizontal and four vertical rollers 210 on axles passing through the walls of the box 209 and secured. The rollers 210 are spaced to allow a square tubular lateral post 211 to pass through easily. The lateral post 211 is bored vertically at the end opposite the book holder 100 to receive a flat head pin 212 which extends below the bottom of the box section 209 thus preventing the lateral post 211 from rolling free of the box section 209. FIG. 7 and FIG. 8 shows the end of the lateral post 211 nearest the book holder 100 is bored on one vertical face with a nut 213A of slightly smaller diameter permanently affixed to the same face and concentric with the bore into which the knob and bolt 213 is threaded.

Figure 9:
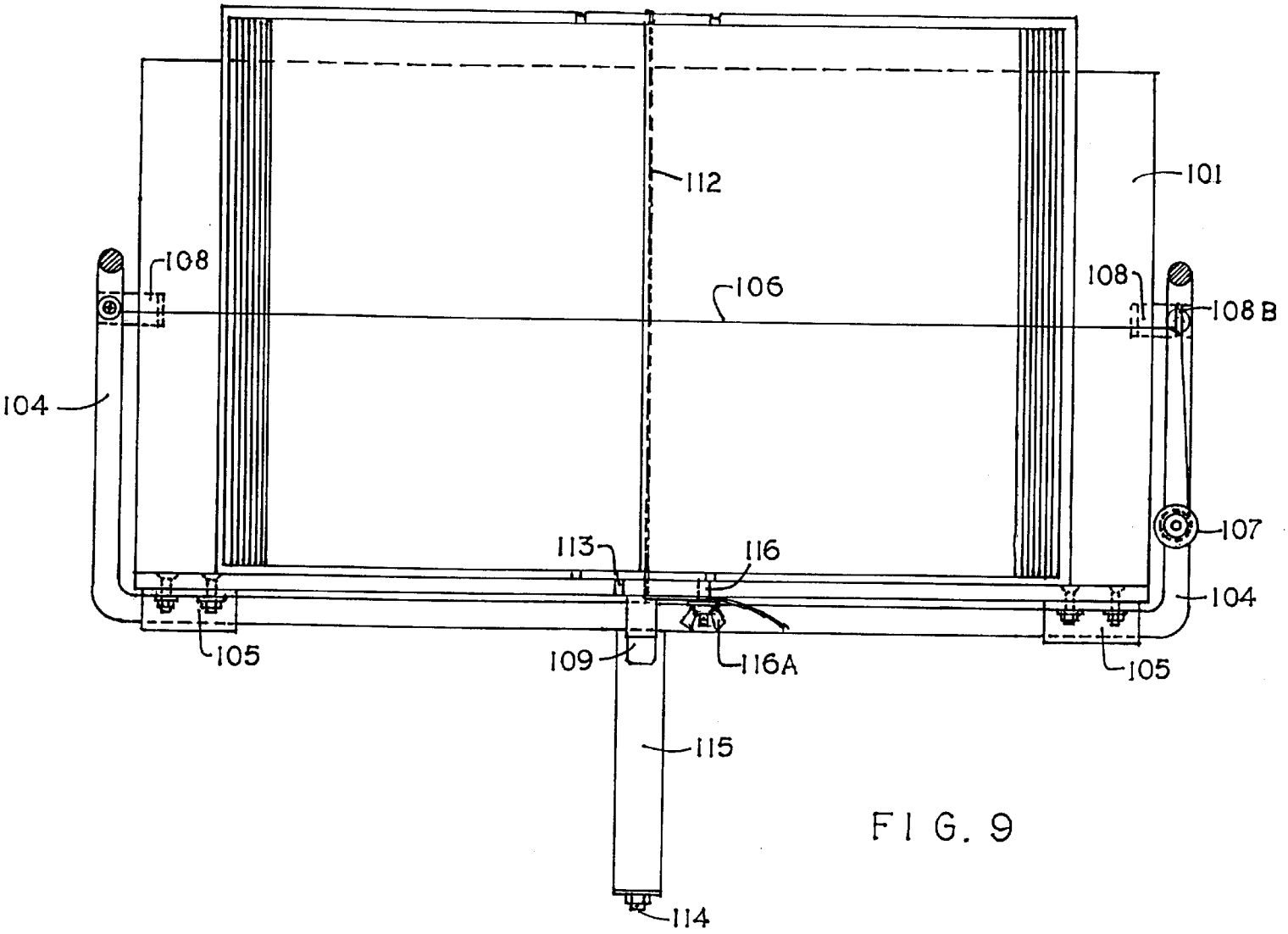
FIG. 9 is a front elevational view of the book support, retraction handle, swing arm and monofilament strand holding the pages of an open book flat.
Figure 14:
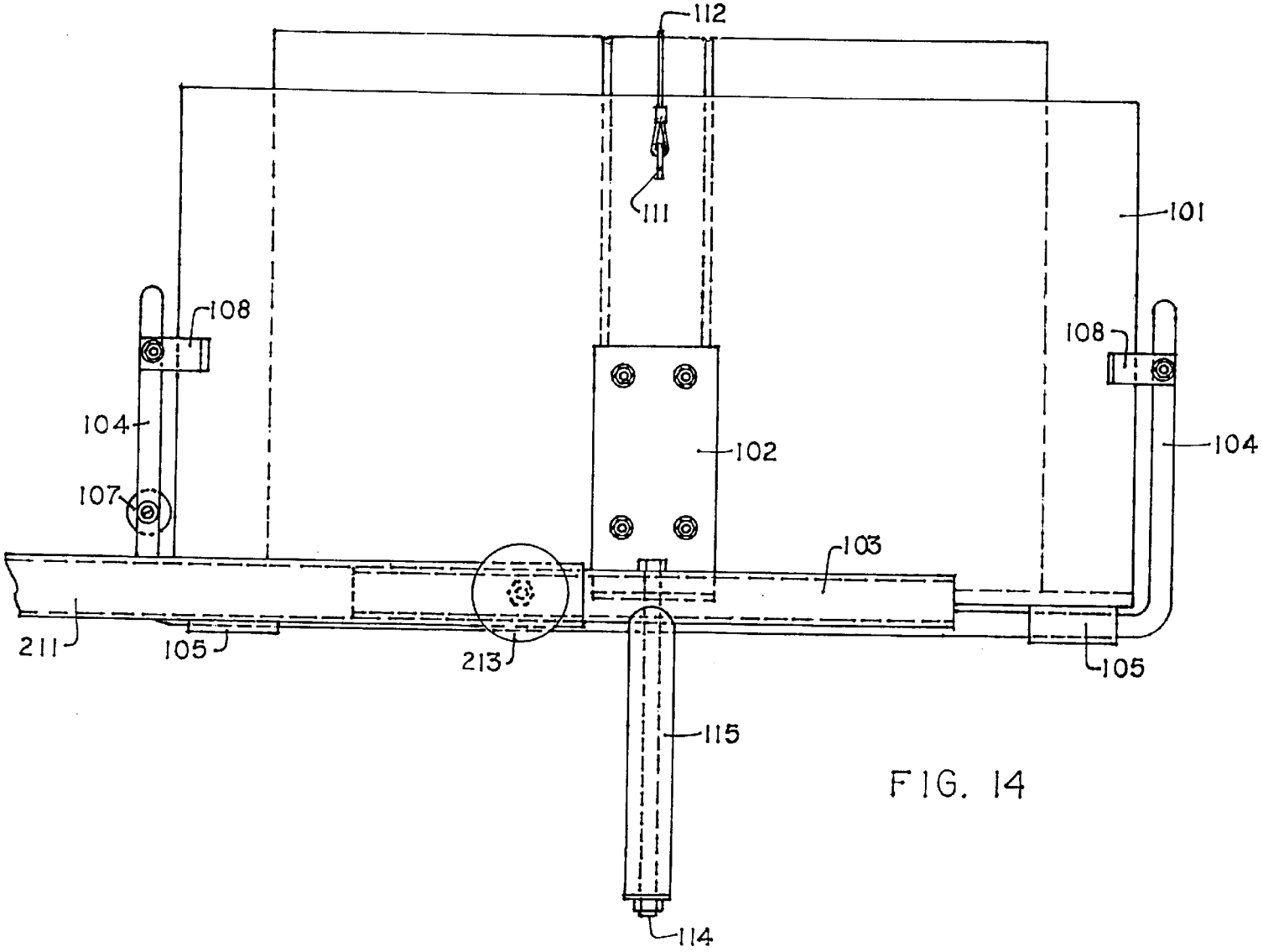
FIG. 14 is a rear elevational view showing the round tube and retraction handle inserted in the end of the lateral post with the pivot adjustment device.

In FIG. 9 the book holder 100 includes a book support 101 of a rigid material, such as molded clear plastic or metal, forming a book support shelf and back. The inside surface is treated using a coating, a chemical or a machining operation so as to render it non-reflective. As illustrated in FIG. 14 an "L" shaped bracket 102 has its' vertical leg fastened to the book support 101 back and its' horizontal leg fastened to a round tube 103 about which the book holder 100 pivots. The end of the tube 103 fits snugly into the square opening at the end of the lateral post 211 where it can be rotated and locked in any position by tightening the knob and-bolt 213 located on the lateral post 211. A retraction handle 115 is fastened to the mid point of the tube 103 by a bolt 114. The retraction handle 115 facilitates the rotation of the book holder 100 and the retraction of the lateral post 211 through the rollers 210. Any vertical rocking motion or pivoting from the eccentric force exerted by the book holder 100 tends to impede the retraction of the lateral post 211 through the rollers 210. This problem is eliminated by twisting the retraction handle 115 to counter the eccentric force as the book holder 100 is retracted.

The book holder 100 can be used on either the left or right side of the reader simply by removing and reversing the lateral post 211 in the box section 209 and then removing and reversing the round tube 103 in the lateral post 211. The horizontal leg of the bracket 102 is of sufficient length to allow the book holder 100 to clear the box section 209 when the lateral post is retracted.

Figure 11:
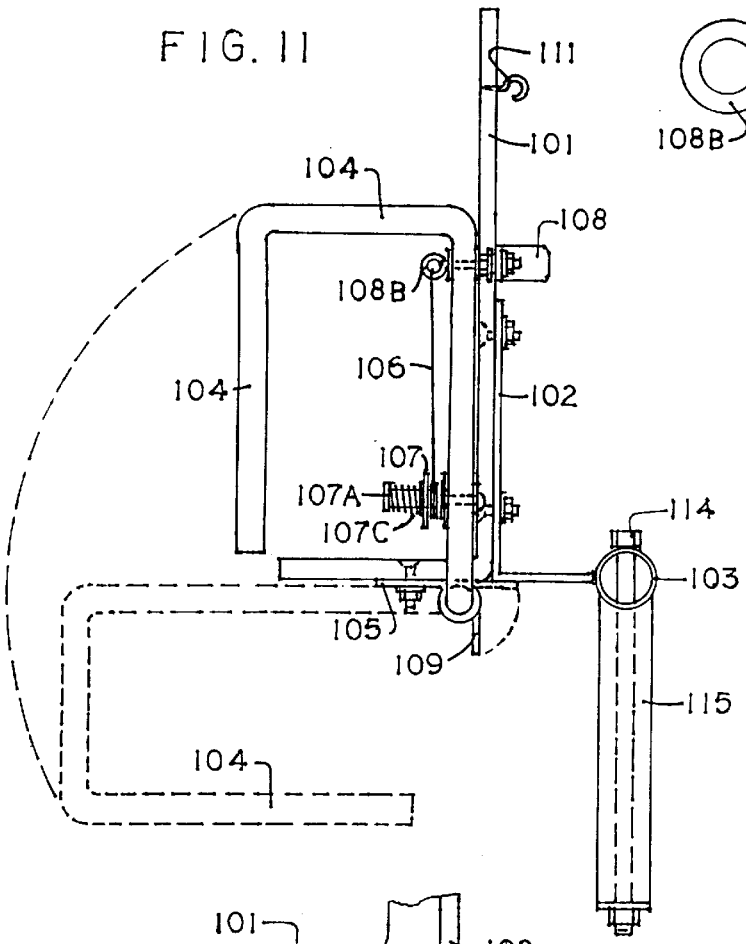
FIG. 11 is a side elevational view of the book support, retraction handle, swing arm, monofilament line, bracket and round tube.
Figure 12:
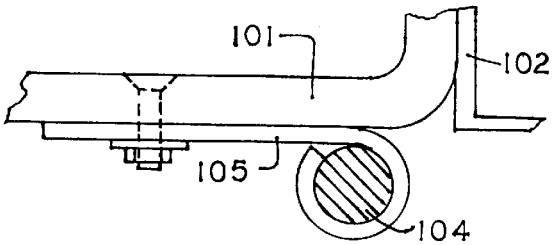
FIG. 12 is a partial cross sectional view showing the means of attachment of the swing arm to the book support shelf.

FIG. 11 shows a swing arm 104 running under and parallel to the book support 101 shelf, which bends substantially 90 degrees to run vertically; and bends substantially 90 degrees to run horizontally and perpendicular to the book support 101 back; and bends substantially 90 degrees again to form vertical handles. FIG. 12 depicts swing arm 104 connected to the book support 101 by means of hinge leaves 105 fastened to the underside of the book support 101 shelf with the swing arm 104 rotating freely through the hinge leaves 105.

FIG. 19 shows a bolt, washer, binding post 107A, and compression spring 107C assembly, mounted through a bore in one side of the swing arm 104 securing one end of a monofilament line 106 around a spool 107. FIG. 11 shows the monofilament line 106 stretched across the book support 101 and through an eye bolt 108B having a spacer 108A, latch 108, washer and nut assembly mounted through a bore in the swing arm 104. FIG. 9 shows monofilament line 106 stretched across and parallel to the text lines. An inverted hook 111, FIG, 11, is fastened to the book support 101 to secure the looped end of a cord 112 shown in. The other end of the cord 112 is secured by passing it through a slot 113 and around a threaded post 116 where it is secured by a wing nut 116A underneath the book support 101 shelf.

Figure 10:
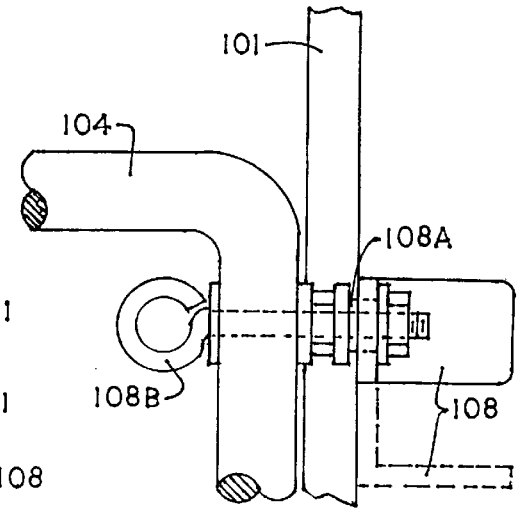
FIG. 10 is a partial elevational view showing the swing arm held in the closed position by the latch.
Figure 13:
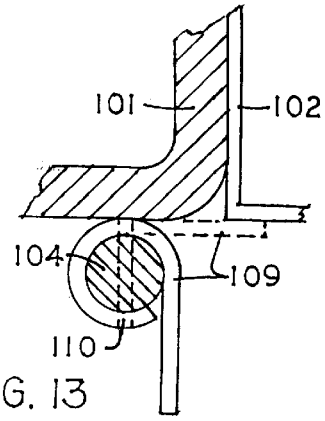
FIG. 13 is a partial cross sectional view showing the means of attachment of the stop to the swing arm.

In FIG. 10 a latch 108 freely rotating on a spacer 108A locked between washers and nuts on the bolt The latch 108 extends behind the book support 101 back when rotated, thus preventing the swing arm 104 from swinging open. Additionally, in FIG. 13, a stop 109 similar to a hinge leaf is rigidly fastened to the center of the swing arm 104 by means of a pin 110, or other means, which limits the rotation of the swing arm 104 when the stop 109 extension contacts the bottom of the bracket 102.

To insert a book onto the book holder 100, the user rotates the book holder 100 backward to the point where the book will rest on the book support 101 without further assistance. Then the user moves the swing arm 104 to the open position after releasing the latches 108, positions the book on the center of the book support 101 and opens the book to its' approximate mid point. The next step is to loop the cord 112 over the inverted hook 111, carry the cord 112 over the top of the book support 101 back, down in the "V" formed formed by the open book, through the slot 113 in the book support 101 shelf, then pull the cord 112 tight and wind it around the threaded post 116 where it is secured by tightening a wing nut 116A. The swing arm 104 is then moved to the closed position, the monofilament line 106 is tightened to the desired tension by rotating the spool 107 which is then locked in place by fitting it over the locking pin 107B In the closed position, the free swinging latches 108 are kept in place by a pressure exerted by the latches 108 against the back of the book support shelf 101 caused by an outward pressure exerted by the book upon the monofilament line 106. To remove the book, the user loosens the knob and bolt 213 on the lateral post 211, rotates the the book holder 100 backward to the point where the book will rest without additional support, then tightens the knob and bolt 213. Next, the swing arm 104 is moved from the closed position to the open position by pushing back the swing arm 104 which removes the pressure exerted by the free swinging latches 108 against the back of the book support shelf 101 such that the free swinging latches 108 drop clear of the book support shelf 101, after which the swing arm 104 is rotated down until the swing arm 104 is parallel with the bottom of the book support shelf 101. Next, the user loosens the wing nut 116A, pulls the cord 112 free and removes the book.

In operation, while reading, the swing arm 104 is in the closed o position, held there by the latches 108, and the moofilament line 106 is pressed against the pages of the book forcing them to lay flat. The thin, clear monofilament line 106 is parallel to the text and causes little or no obstruction of the text. However, should the reader ever have a viewing problem, a slight finger pressure will move the monofilament line 106 to the space between he printed lines. The book holder 100 can be locked at any point in a 360 degree rotation, can be raised or lowered or laterally retracted by using the retraction handle 115 to move the lateral post 111 through rollers 210 allowing the reader to rise from a sitting or reclining position without having to move the entire assembly out of the way. Additionally, it can easily be converted to left or right hand use by reversing the lateral post 211 in the box section 209 and also the round tube 103 in the lateral post 211.

While preferred embodiments of the invention have been shown and described herein, it will be understood that such embodiments are provided by way of example only. Numerous variations, changes, and substitutions will occur to those skilled in the art without departing from the spirit of the invention. Accordingly, it is intended that the appended claims cover all such variations as fall within the spirit and scope of the invention.

What is claimed is:

1. An assembly comprising:

a book having one or more pages, an adjustable book holder to permit hands-free reading and hand-assisted page turning of the book, the adjustable book holder comprising a book support shelf onto which the book is secured, a swing arm, a single length of monofilament line attached to opposite sides of the swing arm, the one or more pages of the book being held open by the single length of monofilament line, the swing arm allowing the book to be removed from the holder when the swing arm is in an open position, the swing arm is freely rotatable through hinge leaves attached to an underside of the book support shelf whereby the swing arm is held in a closed position by free swinging latches fastened to the swing arm and turned up behind a back of the book support shelf.

2. The assembly according to claim 1 whereby, in the closed position, the free swinging latches are kept in place by a pressure exerted by the free swinging latches against the back of the book support shelf caused by an outward pressure exerted by the book upon the monofilament line.

3. The assembly according to claim 2 whereby the swing arm is moved from the closed position to the open position by pushing back the swing arm which removes the pressure exerted by the free swinging latches against the back of the book support shelf allowing said free swinging latches to drop clear of the book support shelf, such that the swing arm may be rotated down until the swing arm is parallel with the bottom of the book support shelf.

4. The assembly according to claim 3 whereby the monofilament line can be adjusted to books of different widths or thickness by a spool wound with the monofilament line and mounted on one side of the swing arm, which then can be rotated to the correct tension and locked in place; and whereby the book is held to the book support by a cord looped over a hook at the back of the book support and placed in the center of the book when the book is opened at the mid point thereof, then the cord is fed through a slot and then the cord is tightened and secured to a post inserted in the book support shelf.

* * * * *